US009703237B2

(12) United States Patent
Noguchi

(10) Patent No.: US 9,703,237 B2
(45) Date of Patent: Jul. 11, 2017

(54) DEVELOPING UNIT

(71) Applicant: CANON KABUSHIKI KAISHA, Tokyo (JP)

(72) Inventor: Akihiro Noguchi, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/859,687

(22) Filed: Sep. 21, 2015

(65) Prior Publication Data

US 2016/0091829 A1 Mar. 31, 2016

(30) Foreign Application Priority Data

Sep. 25, 2014 (JP) ..... 2014-194939
Jul. 15, 2015 (JP) ..... 2015-141076

(51) Int. Cl.
*G03G 15/08* (2006.01)
*G03G 15/09* (2006.01)

(52) U.S. Cl.
CPC ..... *G03G 15/0921* (2013.01); *G03G 15/0928* (2013.01)

(58) Field of Classification Search
CPC ..... G03G 15/0921; G03G 15/0928
See application file for complete search history.

(56) References Cited

U.S. PATENT DOCUMENTS 7,769,327 B2 * 8/2010 Morimoto ..... G03G 15/0812 399/267
8,725,044 B2 5/2014 Nose et al.
2013/0129376 A1 * 5/2013 Noguchi ..... G03G 15/09 399/104
2013/0243489 A1 * 9/2013 Sakamaki ..... G03G 15/0893 399/254

FOREIGN PATENT DOCUMENTS

JP H05-333691 A 12/1993

* cited by examiner

*Primary Examiner* — David M Gray
*Assistant Examiner* — Michael Harrison
(74) *Attorney, Agent, or Firm* — Fitzpatrick, Cella, Harper & Scinto

(57) ABSTRACT

A multipolar magnet is arranged inside a developer bearing member. A partitioning wall is arranged such that an apex position thereof is located between the developer bearing member and a first conveying member, and is extended up to a position which is located below an upper end position of a zone. A plurality of concaved portions is formed on the surface of the developer bearing member at an interval. Each of the plurality of concaved portions has such an opening shape that a maximum diameter of an inscribed circle is equal to or greater than a diameter of an average grain size of a carrier, and is formed such that the carrier with the average grain size is able to enter each of the concaved portions by a depth that is equal to or greater than a radius thereof.

20 Claims, 11 Drawing Sheets

DEVELOPING UNIT

BACKGROUND OF THE INVENTION

Field of the Invention

This disclosure relates to a developing unit that develops a latent image formed on an image carrier by an electrophotographic system, an electrostatic recording system, or the like to form a visible image.

Description of the Related Art

In an image forming apparatus using an electro-photographic system in the related art, an electrostatic latent image that is formed on an image bearing member, such as a photosensitive drum, is developed by a developing unit by using a toner. As such a developing unit, a developing unit adapting a vertical agitating and function separation type is known. This vertical agitating and function separation type developing unit is configured to array a first chamber for supplying a developer to a developing sleeve as a developer bearing member and a second chamber for collecting the developer from the developing sleeve vertically. In a case of a configuration disclosed in JP-A-5-333691, for example, a circulation path for circulating the developer between the first chamber and the second chamber is formed by partitioning the first chamber and the second chamber with a partitioning wall and causing a pair of communication portions formed in the partitioning wall to communicate between the first chamber and the second chamber.

Here, in the case of such a developing unit of the vertical agitating and function separation type as disclosed in JP-A-5-333691, an agent surface of the developer in the first chamber is inclined downward toward the communication portion for sending the developer from the first chamber to the second chamber. Then, a coating property of the developer easily becomes unstable, and for example, the developing sleeve is unevenly coated with the developer. Thus, it is considered that an apex of the partitioning wall positioned between the developing sleeve and a conveyor screw is lowered to facilitate the supply of the developer to the developing sleeve even at the position at which the agent surface is lowered.

However, in the case of the configuration of the vertical agitating and function separation type, a repelling pole for peeling off the developer from the developing sleeve in order to collect the developer from the developing sleeve to the second chamber tends to be arranged so as to be adjacent to the conveyor screw in a substantially horizontal direction. Therefore, if the apex of the partitioning wall is lowered as described above, an area where magnetic force becomes zero between the repelling poles tends to be positioned at or near a location where the developer is supplied from the first chamber to the developing sleeve. In such a case, the developer that is supplied from the first chamber to the developing sleeve tends to drop without being borne by the developing sleeve. If the developer drops as described above, the developer tends to be stored in the lower chamber that corresponds to the second chamber. Therefore, there is a possibility that dragging, in which the developer in the second chamber is dragged by the developing sleeve, occurs and the property of coating the developing sleeve with the developer becomes unstable. In addition, there is also a possibility that overflowing of the developer occurs because the developer on the developing sleeve cannot be sufficiently introduced into the second chamber.

SUMMARY OF THE INVENTION

In view of the above circumstances, this disclosure provides a configuration in which the developer does not tend to drop into the second chamber while the property of coating the developer bearing member with the developer is stabilized.

According to an aspect of this disclosure, there is provided a developing unit including a developer bearing member configured to bear a developer, containing a non-magnetic toner and a magnetic carrier, on a surface thereof, carry the developer, and develop a latent image, a developing container configured to accommodate the developer, the developing container including a first chamber supplying the developer to the developer bearing member, a second chamber arranged below the first chamber and forming a collecting path configured to collect the carried developer through the developer bearing member after development without causing the developer to pass through the first chamber and a circulation path circulating the developer between the first chamber and the second chamber, and a partitioning wall partitioning the first chamber and the second chamber, a first conveying member configured to be arranged in the first chamber such that the center thereof is positioned between an upper end and a lower end of the developer bearing member and to convey the developer, a second conveying member configured to be arranged in the second chamber and convey the developer, a regulation member configured to regulate the amount of developer that is borne by the developer bearing member, and a multipolar magnet arranged inside the developer bearing member, the multipolar magnet including a first magnetic pole arranged at a position where the first magnetic pole faces the regulation member or on a position upstream, in a conveying direction of the developer bearing member, of the position where the first magnetic pole faces the regulation member such that a peak position of magnetic force thereof on the surface of the developer bearing member is located above a center of the developer bearing member and is located downstream, in the conveying direction, of a line that connects the center of the developer bearing member and the center of the first conveying member, and a second magnetic pole having the same polarity with that of the first magnetic pole, the second magnetic pole arranged to be adjacent to the first magnetic pole upstream, in the conveying direction, of the first magnetic pole such that a peak position of magnetic force on the surface of the developer bearing member is located below the center of the developer bearing member and is located downstream, in the conveying direction, of a line that connects the center of the developer bearing member and the center of the second conveying member. An apex position of the partitioning wall is located between the developer bearing member and the first conveying member, and below an upper end position of a zero-gauss zone in which magnetic force on the surface of the developer bearing member becomes substantially zero between the first magnetic pole and the second magnetic pole. A plurality of concaved portions is formed on a surface of the developer bearing member at an interval. Each of the plurality of concaved portions has such an opening shape that a maximum diameter of an inscribed circle is equal to or greater than a diameter of an average grain size of the carrier, and is formed such that the carrier with the average grain size is able to enter each of the concaved portions by a depth that is equal to or greater than a radius thereof.

Further features of the present invention will become apparent from the following description of exemplary embodiments with reference to the attached drawings.

DESCRIPTION OF THE EMBODIMENTS

<First Embodiment>

Figure 1:
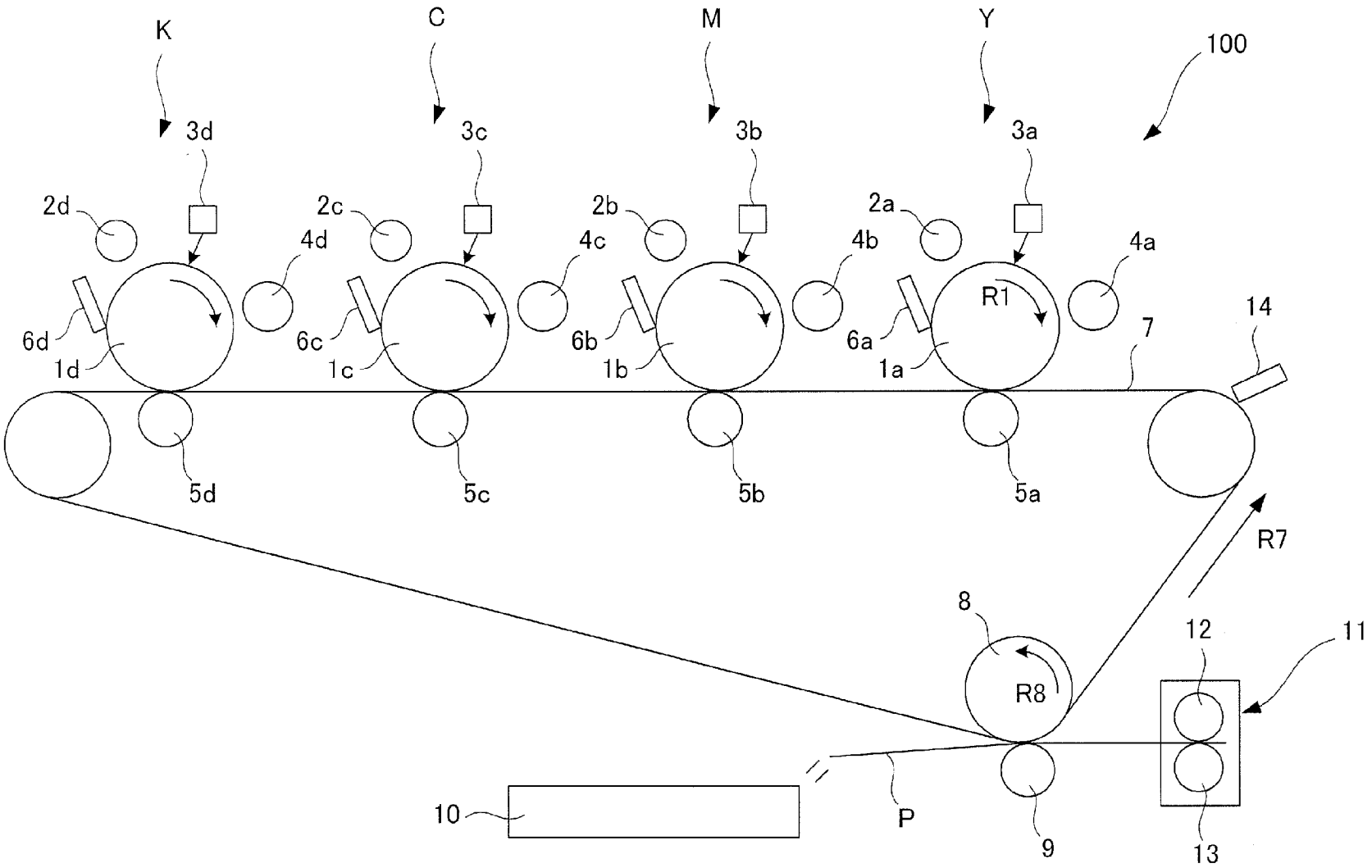
FIG. 1 is a schematic diagram of an image forming apparatus of a first embodiment.

A first embodiment will be described with reference to FIGS. 1 to 8. First, a description will be given of an outline configuration of an image forming apparatus according to this embodiment with reference to FIG. 1.

[Image Forming Apparatus]

An image forming apparatus 100 is a full-color printer based on the electro-photographic system, which is provided with four image forming stations Y, M, C, and K. The image forming apparatus 100 forms a toner image (image) on a recording medium P in response to an image signal from a host device such as an document reading device (not shown) that is connected to an apparatus body or a personal computer that is connected to the apparatus body so as to communicate with the apparatus. Examples of the recording medium include sheet materials such as paper, a plastic film, and cloth. In addition, the image forming stations Y, M, C, and K form yellow, magenta, cyan, and black toner images, respectively.

It is noted that the four image forming stations Y, M, C, and K provided in the image forming apparatus 100 have substantially the same configuration except for different developing colors. Therefore, a configuration of the image forming station Y forming a yellow toner image will be described first as a representative example.

A cylindrical photosensitive body, namely a photosensitive drum 1*a*, as an image bearing member is disposed in the image forming station. The photosensitive drum 1*a* is rotated in the direction of the arrow R1 in the drawing. A charging unit (charging roller) 2*a*, a developing unit 4*a*, a primary transfer roller 5*a*, and a cleaning unit 6*a* are arranged in the circumference of the photosensitive drum 1*a*. A laser scanner (exposing unit) 3*a* is arranged above the photosensitive drum 1*a* in the drawing.

An endless intermediate transfer belt 7 as an intermediate transfer member is provided below each image forming station in FIG. 1. The intermediate transfer belt 7 is pressed by primary transfer rollers 5*a*, 5*b*, 5*c*, and 5*d* from the rear surface side thereof, and the front surface thereof contacts with photosensitive drums 1*a*, 1*b*, 1*c*, and 1*d*. The intermediate transfer belt 7 is designed to be rotated in the direction of the arrow R7 in association with the rotation of a secondary transfer counter roller 8, which also functions as a drive roller, in the direction of the arrow R8. A rotation speed of the intermediate transfer belt 7 is set so as to be substantially the same as the rotation speed (process speed) of the aforementioned respective photosensitive drums 1*a*, 1*b*, 1*c*, and 1*d*.

A secondary transfer roller 9 is disposed at a position, which corresponds to the secondary transfer counter roller 8, on the surface of the intermediate transfer belt 7. The secondary transfer roller 9 nips the intermediate transfer belt 7 with the secondary transfer counter roller 8, and a secondary transfer nip (secondary transfer portion) is formed between the secondary transfer roller 9 and the intermediate transfer belt 7.

Recording media P on which image formation is to be performed are accommodated in a cassette 10 in a stacked state. The recording media P are supplied to the aforementioned secondary transfer nip portion by feeding and conveying devices (both of which are not shown in the drawing) that are provided with a feed roller, a conveyance roller, a registration roller, and the like. A fixing unit 11 that is provided with a fixing roller 12 and a pressing roller 13 that is pressed by the fixing roller 12 is disposed on the downstream side of the secondary transfer nip portion in a conveying direction of the recording media P, and a discharge tray that is not illustrated in the drawing is disposed on the further downstream side of the fixing unit 11.

A description will be given of a process for forming a four-full-color image, for example, by the image forming apparatus 100 configured as described above. First, if an image forming operation is started, the surface of the rotating photosensitive drum 1*a* is uniformly charged by the charging unit 2*a*. Then, the photosensitive drum 1*a* is exposed to laser light in accordance with an image signal that is generated by the exposing unit 3*a*. In doing so, an electrostatic latent image in accordance with the image signal is formed on the photosensitive drum 1*a*. The electrostatic latent image on the photosensitive drum 1*a* is visualized by a toner accommodated in the developing unit 4*a* and a visible image is formed. In this embodiment, a reverse developing system in which the toner is made to adhere to a bright part potential exposed to the laser light is employed.

The toner image formed on the photosensitive drum 1*a* is primarily transferred to the intermediate transfer belt 7 by the primary transfer portion that is configured along with the primary transfer roller 5*a* arranged so as to nip the intermediate transfer belt 7 therebetween. At this time, a primary transfer bias is applied to the primary transfer roller 5*a*. The toner (transferring residual toner) that remains on the surface of the photosensitive drum 1*a* after the primary transfer is removed by the cleaning unit 6*a*. The photosensitive drum 1*a*, after the removal of the transferring residual toner, is subjected to the next image formation.

Such an operation is sequentially performed by the respective image forming stations for yellow, magenta, cyan, and black colors, and toner images of the four colors are overlapped on the intermediate transfer belt 7. That is, toner images of the respective colors are formed on the respective photosensitive drums 1*b*, 1*c*, and 1*d* in the same manner as in the aforementioned image forming station Y. Then, the toner images of the respective colors are sequentially transferred to and superimposed on the intermediate transfer belt 7. It is noted that indexes a, b, c, and d of reference numerals that indicate configurations of the respective image forming stations represent configurations of the respective image forming stations of yellow, magenta, cyan, and black, respectively.

Thereafter, a recording medium P accommodated in the cassette 10 is conveyed by the secondary transfer portion at a toner image formation timing. Then, the toner images of the four colors, which are formed on the intermediate transfer belt 7, are collectively and secondarily transferred to the recording medium P by applying a secondary transfer bias to the secondary transfer roller 9. The toner that is not completely transferred by the secondary transfer portion and remains on the intermediate transfer belt 7 is removed by an intermediate transfer belt cleaner 14.

Then, the recording medium P is conveyed to the fixing unit 11. Then, the recording medium P is heated and pressed by causing the recording medium P with the toner image transferred thereto to pass through the fixing nip portion that is formed by the fixing roller 12 and the pressing roller 13. Then, the toner on the recording medium P is melted, mixed, and then fixed as a full-color image on the recording medium P. Thereafter, the recording medium P is discharged to the discharge tray. In doing so, a series of image forming processes is completed. It is noted that it is also possible to form an image of a desired single color or desired multiple colors by using only the desired image forming stations.

[Developing Unit]

Figure 2:
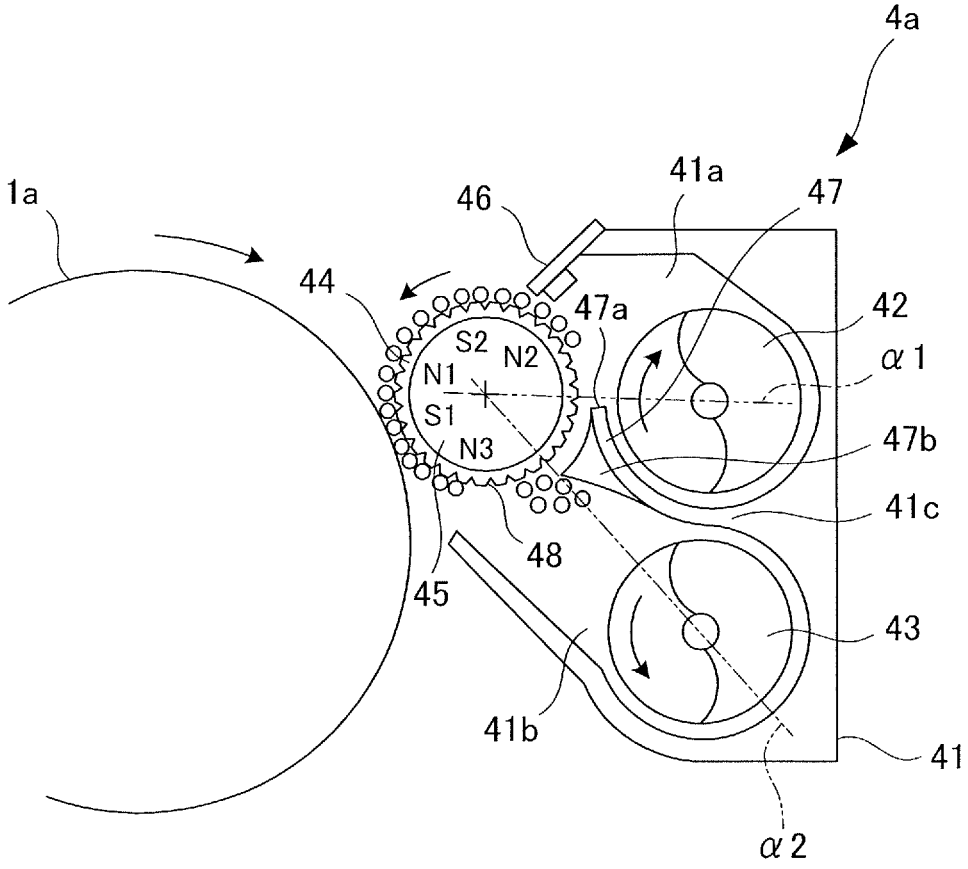
FIG. 2 is a cross section view illustrating an outline configuration of a developing unit of the first embodiment.
Figure 3:
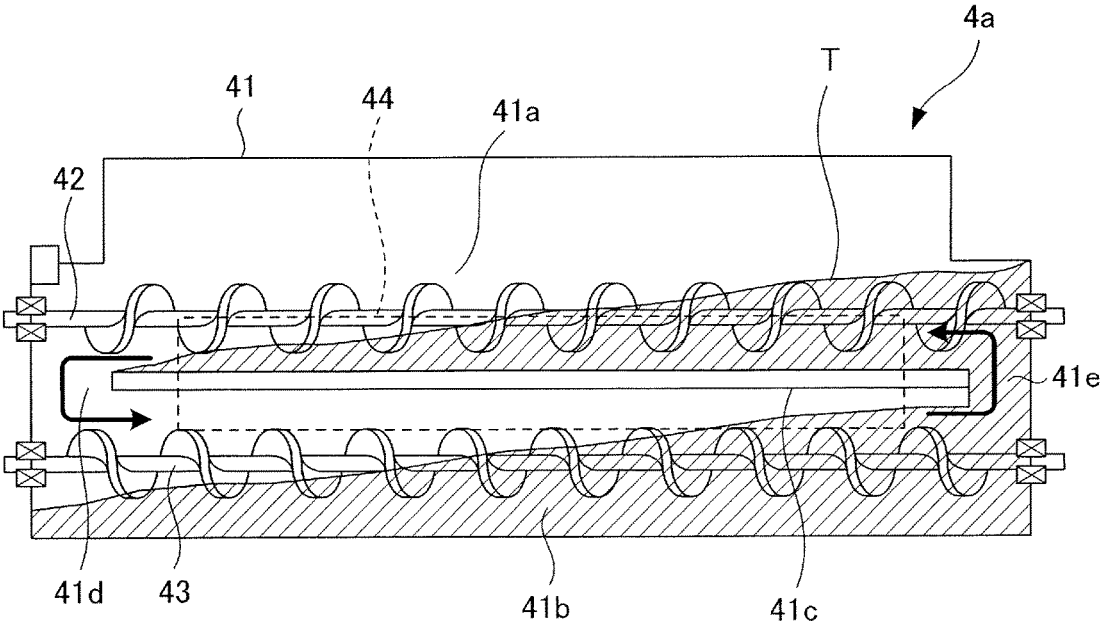
FIG. 3 is a longitudinal section view illustrating an outline configuration of the developing unit of the first embodiment.

Next, a description will be given of the developing unit 4*a* with reference to FIGS. 2 to 4C. It is noted that since the developing units in the respective image forming stations have the same configuration in this embodiment, the following description can also be applied to the developing units 4*b*, 4*c*, and 4*d*. FIG. 2 is a cross section view illustrating an outline configuration of the developing unit 4*a* cut in a direction that is orthogonal to a rotation axis direction of a developing sleeve 44 that will be described later. FIG. 3 is a longitudinal section view illustrating an outline configuration of the developing unit 4*a* cut in the rotation axis direction of the developing sleeve 44.

The developing unit 4*a* is provided with a developing container 41, and a two-constituent developer containing a non-magnetic toner and a magnetic carrier as a developer is accommodated in the developing container 41. Here, the developer will be described. In this embodiment, a two-constituent developing system is employed as a developing system, the non-magnetic toner and the magnetic carrier are mixed, and the mixture is used as a developer. The non-magnetic toner is obtained in the form of powder by causing resin such as polyester or acrylic styrene to contain a colorant, a wax constituent, and the like and pulverizing or polymerizing the mixture. The magnetic carrier is obtained by coating surface layers of cores that are formed of resin particles, which are obtained by kneading ferrite particles or magnetic powder, with resin.

In addition, the developing sleeve 44 as a developer bearing member and a regulating blade 46 as a regulation member for regulating (cutting) a nap of the developer borne above the developing sleeve 44 are provided inside the developing container 41. The developing sleeve 44 is configured of a non-magnetic material such as aluminum or stainless steel, is rotatably supported by the developing container 41, and is rotated in the direction of the arrow in FIG. 2. A magnet roller 45 as a multipolar magnet is installed inside the developing sleeve 44 in a non-rotatable state.

In the embodiment, the inside of the developing container 41 is partitioned at substantially the center thereof by a partitioning wall 41*c*, which extends in a direction orthogonal to the sheet surface of FIG. 2, into a developing chamber 41*a* as the first chamber and an agitating chamber 41*b* as the second chamber. That is, the developing chamber 41*a* and the agitating chamber 41*b* are partitioned by the partitioning wall 41*c*. The developing unit 4*a* according to the embodiment has a configuration of a vertical agitating type in which the agitating chamber 41*b* is arranged below the developing chamber 41*a*, and the developer is respectively accommodated in the developing chamber 41*a* and the agitating chamber 41*b*. Openings 41*d* and 41*e* for communicating between the developing chamber 41*a* and the agitating chamber 41*b* are provided in both ends of the partitioning wall 41*c* in the axial direction of the developing sleeve 44 as illustrated in FIG. 3. In addition, a rising portion 47 that rises so as to be bent upward is formed at the partitioning wall 41*c* on the side of the developing sleeve 44, and the rising portion 47 is positioned between the developing sleeve 44 and a first conveyor screw 42 which will be described below.

The first conveyor screw 42 as the first conveying member for conveying the developer while agitating the developer is arranged in the developing chamber 41*a*, and a second conveyor screw 43 as the second conveying member for conveying the developer while agitating the developer is arranged in the agitating chamber 41*b*. The first conveyor screw 42 is arranged at the bottom of the developing chamber 41*a* so as to be substantially parallel to the axial direction of the developing sleeve 44 and is rotated in the direction of the arrow in FIG. 2 (clockwise direction) to convey the developer in the developing chamber 41*a* in one direction along the axial direction. The first conveyor screw 42 is rotated in the clockwise direction because it is advantageous from a viewpoint of supply of the developer to the developing sleeve 44. In addition, the first conveyor screw 42 is arranged such that the center thereof is positioned between an upper end and a lower end of the developing sleeve 44. In the embodiment, the first conveyor screw 42 is arranged so as to be adjacent to the developing sleeve 44 in the substantially horizontal direction. Moreover, the second conveyor screw 43 is arranged at the bottom of the agitating chamber 41*b* so as to be substantially parallel to the first conveyor screw 42 and is rotated in the direction opposite to that of the first conveyor screw 42 (counterclockwise direction) to convey the developer in the agitating chamber 41*b* in the direction opposite to that of the first conveyor screw 42.

As described above, the developer is circulated between the developing chamber 41*a* and the agitating chamber 41*b* through the openings (communication portions) 41*d*and 41*e* at both ends of the partitioning wall 41*c* by being conveyed by the rotation of the first conveyor screw 42 and the rotation of the second conveyor screw 43. That is, a circulation path of the developer is formed by the developing chamber 41*a* and the agitating chamber 41*b*. Then, the toner is charged by agitating and conveying the developer in the circulation path. The developer conveyed to the developing chamber 41*a* is supplied to the developing sleeve 44 and is adsorbed and borne by the surface of the developing sleeve 44 due to a magnetic field formed by a magnet roller 45 that is arranged in the developing sleeve 44. Specifically, the toner adheres to the surface of the carrier with a sufficiently larger grain size than that of the toner by charging the toner and the carrier to have mutually opposite polarities. Then, the carrier with a magnetic property, the surface of which is adhered to by the toner, is adsorbed and borne by the surface of the developing sleeve 44 due to the magnetic field formed by the magnet roller 45. The developing sleeve 44 is rotated in the arrow direction to carry the borne developer to a portion (developing portion) facing the photosensitive drum 1*a*.

In this embodiment, an opening is provided at a position, which corresponds to a developing area that faces the photosensitive drum 1*a*, in the developing container 41, and the developing sleeve 44 is rotatably disposed at the opening such that a part thereof is exposed in the direction of the photosensitive drum 1*a*. Here, the diameter of the developing sleeve 44 is set to 20 mm, the diameter of the photosensitive drum 1*a* is set to 80 mm, and furthermore, the distance of the closest area between the developing sleeve 44 and the photosensitive drum 1*a* is set to about 300 μm. In doing so, the setting is made such that developing can be performed in a state in which the developer carried to the developing portion by the developing sleeve 44 is in contact with the photosensitive drum 1*a*. That is, the electrostatic latent image formed on the photosensitive drum 1*a* is developed by the toner by bringing the developer borne on the developing sleeve 44 into contact with the photosensitive drum 1*a* and applying a predetermined developing bias of the developing sleeve 44. The developer that remains on the developing sleeve 44 after the development is collected in the agitating chamber 41*b* without being made to pass through the developing chamber 41*a*. That is, the developing unit 4*a* according to the embodiment has a configuration of the so-called vertical agitating and function separation type, which includes the developing chamber 41*a* for supplying the developer to the developing sleeve 44 and the agitating chamber 41*b* that is arranged below the developing chamber 41*a* and forms a collecting path for collecting the developer from the developing sleeve 44.

It is noted that a toner refilling port for refilling the toner is provided at a part of the agitating chamber 41*b*. In addition, a developer refilling apparatus which is not illustrated in the drawing is connected to the toner refilling port such that the inside of the developing container 41 is refilled with the toner and the like which is consumed during development. The toner refilling port is typically provided in the agitating chamber 41*b* in order to agitate the toner and the carrier as much as possible and stabilize the toner charge amount until the developer is supplied from the developing chamber 41*a* to the developing sleeve 44.

Next, a detailed description will be given of configurations of the developing sleeve 44 and the magnet roller 45 according to the embodiment. First, a description will be given of magnetic pole arrangement of the magnet roller 45.

[Magnetic Pole Arrangement]

The magnet roller 45 includes a plurality of magnetic poles S1, S2, N1, N2, and N3 as illustrated in FIG. 2. Positions, at which reference numerals of the respective magnetic poles are illustrated, in FIG. 2 substantially represent positions at which the magnetic force of the magnetic poles reaches peaks thereof. The magnetic pole S1 is a developing pole arranged at the developing portion that faces the photosensitive drum 1*a*. The magnetic pole N2 as the first magnetic pole is arranged at a position, at which the magnetic pole N2 substantially faces the regulating blade 46, upstream of the regulating blade 46 in the direction of rotation (conveying direction) of the developing sleeve 44. The magnetic pole N2 is arranged such that a peak position of the magnetic force on the surface of the developing sleeve 44 is located above the center of the developing sleeve 44 on the gravitational direction and on the downstream side in the conveying direction beyond a line α1 that connects the center of the developing sleeve 44 and the center of the first conveyor screw 42. The magnetic poles S2 and N1 are arranged between the magnetic pole S1 and the magnetic pole N2. The magnetic pole N3 as the second magnetic pole is arranged downstream of the magnetic pole S1 in the direction of rotation of the developing sleeve 44. The magnetic pole N3 is arranged upstream, in the conveying direction, of a line α2 that connects the center of the developing sleeve 44 and the center of the second conveyor screw 43 such that the peak position of the magnetic force on the surface of the developing sleeve 44 is located below the center of the developing sleeve 44 in the gravitational direction. In other words, the respective peak positions of the magnetic force of the magnetic pole N2 and the magnetic pole N3, which are repelling poles, are located outside the area that is interposed between the line α1 and the line α2. In doing so, it is possible to widen the interval between the magnetic pole N2 and the magnetic pole N3.

In the embodiment, the magnetic poles N2 and N3 are arranged such that the center of the first conveyor screw 42 is positioned between the magnetic pole N2 and the magnetic pole N3, which are repelling poles, in the vertical direction. In other words, the first conveyor screw 42 is arranged such that the center thereof is located below the peak position of the magnetic force of the magnetic pole N2 and the upper side beyond the peak position of the magnetic force of the magnetic pole N3. The magnetic pole arrangement of the magnet roller 45 according to the embodiment has a configuration in which the magnetic pole N2 arranged so as to substantially face the regulating blade 46 and the magnetic pole N3 as a magnetic pole that is next to the magnetic pole N2 on the upstream side (upstream in the conveying direction) have the same polarity. The developer borne by the developing sleeve 44 is peeled off from the surface of the developing sleeve 44 between the magnetic pole N2 and the magnetic pole N3 and is then collected into the agitating chamber 41*b*.

A configuration including a zero-gauss zone, in which substantially no magnetic flux lines are present between the magnetic poles N2 and N3, the magnetic flux density of which can be substantially regarded as having zero gauss, is obtained by arranging the magnetic pole N2 and the magnetic pole N3 with the same polarity so as to be adjacent to each other. Here, the zero-gauss zone represents an area where the magnetic flux density is equal to or less than 50 gauss in this embodiment. Therefore, a position (zero-gauss zone) in which magnetic force on the surface of the developing sleeve 44 is substantially zero is present between the magnetic pole N2 as the first magnetic pole and the magnetic pole N3 as the second magnetic pole. In doing so, it is possible to prevent a large amount of developer from being present in the vicinity of the regulating blade 46 and to reduce stress applied to the developer. In this embodiment, the minimal position, at which magnetic force is the smallest, in the position (zero-gauss zone) where the magnetic force is substantially zero is on a line that passes through the center of the developing sleeve 44 in the substantially horizontal direction in FIG. 2 (the position corresponding to substantially three-o'clock position when the section view of the developing sleeve 44 is considered as a face of a clock). It is noted that although the minimal position moves depending on the arrangement of the magnetic poles, it is preferable to substantially locate the minimal position within a range from one o'clock to five o'clock, and it is more preferable to locate the minimal position within a range from two o'clock to four o'clock when the section view of the developing sleeve 44 is considered as a face of a clock. In other words, it is preferable to locate the minimal position within a range from 30° to 150°, and it is more preferable to locate the minimal position within a range from 60° to 120° in a clockwise direction from an upper end position (position corresponding to twelve o'clock) of the developing sleeve 44.

[Apex Position of Partitioning Wall]

Here, the developing unit 4*a* according to the embodiment has the configuration of the vertical agitating and function separation type as described above, and the developer is circulated between the developing chamber 41*a* and the agitating chamber 41*b* through the openings 41*d* and 41*e* at both ends of the partitioning wall 41*c*. For this reason, the amount of the developer T that is present in the developing chamber 41*a* decreases toward the opening 41*d* through which the developer T is sent from the developing chamber 41*a* to the agitating chamber 41*b* as illustrated in FIG. 3. That is, the agent surface of the developer T is lowered. This means that the amount of developer decreases toward the downstream in the conveying direction of the developer of the first conveyor screw 42 since the developer is conveyed to the downstream in the conveying direction while being supplied to the developing sleeve 44 by the first conveyor screw 42. As a result, the height of the agent surface of the developer T is lowered at the first conveyor screw 42 in the vicinity of the opening 41*d*, the developer cannot be easily supplied to the developing sleeve 44, and the coating of the developing sleeve 44 with the developer becomes unstable in some cases.

Thus, the partitioning wall 41*c* is arranged such that a position of an apex 47*a* thereof is located between the developing sleeve 44 and the first conveyor screw 42, and is extended up to the position located below the position at which the magnetic force becomes substantially zero between the magnetic pole N2 and the magnetic pole N3 as illustrated in FIG. 2 in this embodiment. That is, the position of the apex 47*a* of the rising portion 47 of the partitioning wall 41*c* is located below the position at which the magnetic force becomes substantially zero. In other words, the height of the apex 47*a* of the partitioning wall 41*c* between the first conveyor screw 42 and the developing sleeve 44 is set such that the area in which the magnetic force formed by the magnet roller 45 becomes substantially zero is located above the height of the apex 47*a*. That is, the apex 47*a* of the partitioning wall 41*c* is located below the position of the upper end of the zero-gauss zone. Furthermore, the position of the apex 47*a* is located below the minimal position of the magnetic force in the zero-gauss zone in the embodiment. The height of the apex 47*a* is the same in the axial direction of the developing sleeve 44. Although the partitioning wall 41*c* is formed such that the position of the apex 47*a* is located below a line α1 that connects the center of the developing sleeve 44 and the center of the first conveyor screw 42, the position of the apex 47*a* may be located above the line α1. In short, any arrangement is applicable as long as the position of the apex 47*a* is located below the position at which the magnetic force is substantially zero. However, it is preferable that the position of the apex 47*a* is located below the line α1 from a viewpoint that the amount of developer supplied from the developing chamber 41*a* to the developing sleeve 44 increases. However, since the developer that is supplied from the developing chamber 41*a* to the developing sleeve 44 tends to drop, the problem that the developer drops, which will be described later, becomes serious.

It is noted that in regard to the height of the apex 47*a* of the rising portion 47 of the partitioning wall 41*c*, a height at which it is possible to sufficiently retain the developer in the developing chamber 41*a* is secured. That is, the height of the rising portion 47 is set such that it is possible to retain an amount of developer large enough to be supplied to the developing sleeve 44 while agitating and conveying the developer by the first conveyor screw 42 in the developing chamber 41*a* that is formed between the partitioning wall 41*c* including the rising portion 47 and the developing container 41.

By lowering the height of the partitioning wall 41*c* between the developing chamber 41*a* and the developing sleeve 44 as described above, it is possible to increase the amount of developer supplied from the developing chamber 41*a* to the developing sleeve 44. As a result, it is possible to sufficiently supply the developer to the developing sleeve 44 even on the downstream side, in the direction in which the developer is conveyed by the first conveyor screw 42, of the developing chamber 41*a* where the height of the agent surface is lowered, and to stabilize the property of coating the developing sleeve 44 with the developer.

It is noted that in this embodiment, a position of the center of rotation of the first conveyor screw 42 in the vertical direction is lower than a position of the center of rotation of the developing sleeve 44 in the vertical direction. In other words, the developing sleeve 44 is arranged such that the center position thereof is higher than the center position of the first conveyor screw 42. In doing so, it is possible to set the height of the position, at which the magnetic force of the magnet roller 45 arranged inside the developing sleeve 44 is substantially zero, to be as high as possible with respect to the first conveyor screw 42. As a result, it becomes easy to set the height of the position, at which the magnetic force of the magnet roller 45 is zero, to be higher than the position of the apex 47*a* of the partitioning wall 41*c*.

Since the interval between the magnetic pole N2 and the magnetic pole N3, which are repelling poles, is set to be wide as described above in this embodiment, it is possible to widen the zero-gauss zone. That is, since the zero-gauss zone is narrow when the interval between the repelling poles is narrow, the developer is not peeled off from the developing sleeve and is easily dragged, and there is a possibility that the property of coating the developing sleeve with the developer becomes unstable. In contrast, the zero-gauss zone is widened by widening the interval between the repelling poles in this embodiment. Therefore, the property of peeling off the developer is enhanced, and it is possible to suppress dragging of the developer by the developer bearing member and to stabilize the property of coating the developing sleeve 44 with the developer.

[Surface Shape of Developing Sleeve]

In contrast, if a large amount of developer is supplied to the developing sleeve 44 as described above, the developer supplied to the developing sleeve 44 drops downward unless force constraining the developer by the developing sleeve 44 is secured. That is, in a configuration in which the developer is supplied to the position at which the density of the magnetic fluxes formed by the magnetic poles N2 and N3 is substantially zero, it is difficult to sufficiently constrain the developer at the developing sleeve 44, and there is a possibility that the developer drops downward. In a configuration including a wide zero-gauss zone as in the embodiment, in particular, it is difficult to constrain the developer at the developing sleeve 44, and dropping of the developer tends to occur. If the developer drops into the agitating chamber 41*b* without providing any arrangement, the developer tends to be stored in the agitating chamber 41*b*. In doing so, dragging in which the developer in the agitating chamber 41*b* is dragged by the developing sleeve 44 occurs, and there is a possibility that the property of coating the developing sleeve 44 with the developer becomes unstable. In addition, there is a possibility that the agitating chamber 41*b* cannot sufficiently accommodate the developer on the developing sleeve 44 and overflowing of the developer occurs.

As a surface shape of the developing sleeve, a configuration with high surface roughness obtained by performing random roughening process such as a blast processing is known in the related art. However, in the case of a developing sleeve with fine ruggedness formed on the surface thereof, the surface is scraped and the force constraining the developer decrease as a period of use increases. Therefore, a risk of the developer dropping increases as the period of use increases in the case of such a configuration.

Figure 4A:
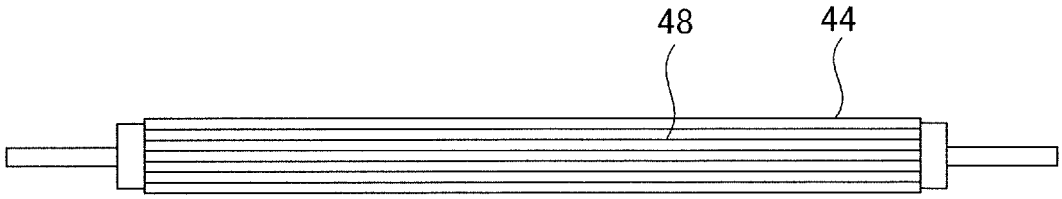
FIG. 4A is a planar view of a developing sleeve of the first embodiment.

Thus, a plurality of grooves 48 as the plurality of concaved portions are formed on the surface of the developing sleeve 44 at an interval as illustrated in FIGS. 2 and 4A to 4C in this embodiment. That is, the plurality of grooves 48 are formed on the surface of the developing sleeve 44 in a direction (axial direction) intersecting the direction of rotation (conveying direction) of the developing sleeve 44 as illustrated in FIG. 4A. The plurality of grooves 48 are formed in parallel to each other at an interval in the direction of rotation. In addition, each of the plurality of grooves 48 has such an opening shape that the maximum diameter of an inscribed circle is equal to or greater than an average grain size of the carrier, and is formed such that the carrier with the average grain size can enter each of the grooves 48 (into each of the concaved portions) by a depth that is equal to or greater than the radius thereof.

Figure 4B:
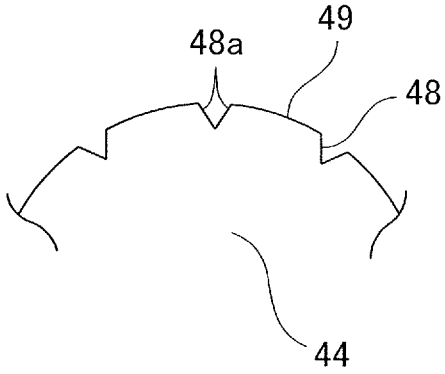
FIG. 4B is an enlarged section view illustrating a part of the developing sleeve of the first embodiment.

The shape of each of the plurality of grooves 48 is a V shape as illustrated in FIG. 4B. That is, each of the plurality of grooves 48 has such a shape that an interval between side walls 48*a* increases toward the opening of each groove 48. Then, the carrier with the average grain size can enter each of the grooves 48 by the depth that is equal to or greater than the radius thereof by appropriately regulating the interval between the side walls 48*a*, the inclined angle, and the like. This is because in the case that the grooves 48 do not have the shape that allow the carrier with the average grain size to enter by the depth that is equal to or greater than the half thereof, the carrier does not tend to be constrained on the surface of the developing sleeve 44 and the ability of carrying the developer by the developing sleeve 44 decrease.

Figure 4C:
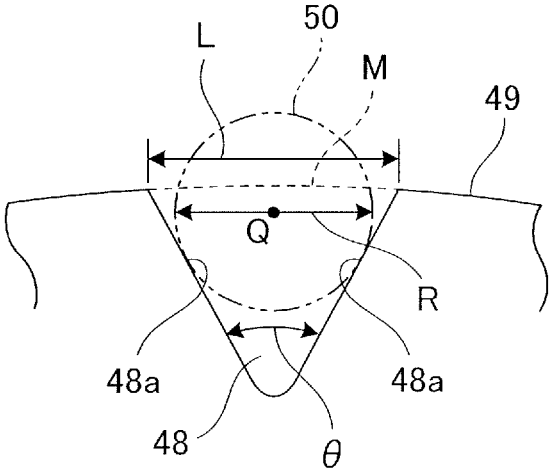
FIG. 4C is a diagram schematically illustrating a state in which a carrier has entered a groove in the developing sleeve of the first embodiment.

Specifically, when the interval between the openings of the grooves 48 is L, the maximum diameter of the inscribed circle of each groove 48 is L as illustrated in FIG. 4C. Therefore, the grooves 48 are formed so as to satisfy L>R where R represents a diameter of a carrier 50 with the average grain size. A state in which the carrier 50 with the average grain size enters each groove 48 by the deepest depth as illustrated in FIG. 4C, that is, a state in which the surface of the spherical carrier 50 is in contact with each of a pair of facing side walls 48*a* will be considered here. Each groove 48 is formed such that a position of a center Q of the carrier 50 with the average grain size is located on the far side of the groove 48 beyond a virtual plane M that connects edges of the opening of the groove 48. It is noted that the virtual plane M is also a plane obtained by continuously connecting projecting portions 49 corresponding parts between the adjacent grooves 48.

In this embodiment, the diameter of the developing sleeve 44 is set to 20 mm, the number of grooves 48 is set to 80, the depth of each groove 48 is set to 60 μm, and a groove angle θ is set to 100°. In addition, the aforementioned plurality of grooves 48 are formed in an area with at least an image formation width of the image forming apparatus 100. In this embodiment, the image formation width is set to 330 mm, and the formation width of the grooves 48 is also set to 330 mm, which is the same as the image formation width. In addition, the average grain size of the carrier ranges from 20 μm to 100 μm, and a carrier with an average grain size of 40 μm is used in this embodiment. It is noted that the average grain size of the carrier is measured by using a laser diffraction particle size analyzer SALD-3000 (manufactured by Shimadzu Corporation) based on the operation manual of the analyzer. Specifically, 0.1 g of magnetic carrier is introduced into the apparatus for measurement, the number of samples is measured for each channel, and a median diameter d50 is calculated as a number average grain size of the samples. In addition, the shape of the grooves 48 is measured by a measurement method using a probe, a laser, or the like, which is known in the related art.

By forming the plurality of grooves 48 with the aforementioned shape on the surface of the developing sleeve 44 as described above, it is possible to enhance the force constraining the developer by the developing sleeve 44 as compared to the configuration including fine ruggedness formed on the surface by a blast processing, for example. In addition, since the plurality of grooves 48 are formed at an interval, the projecting portions 49 between the plurality of grooves 48 are not easily scraped by the developer even if the period of use increases, and it is possible to maintain the force containing the developer to be high over a long period of time.

In this embodiment, the interval between the plurality of grooves 48 (between the concaved portions), that is, the length of the projecting portions 49 in the direction of rotation of the developing sleeve 44 is set to be equal to or greater than the maximum diameter of the inscribed circle of the opening shape of each groove 48, that is, equal to or greater than the interval L of each opening. Therefore, the projecting portions 49 are barely scraped, and it is possible to stably maintain the force constraining the developer over a long period of time.

[Facing Member]

In this embodiment, the partitioning wall 41*c* includes a facing member 47*b* that is provided so as to be adjacent to and face the developing sleeve 44. The facing member 47*b* is formed so as to protrude from the rising portion 47 toward the developing sleeve 44, and a surface that faces the surface of the developing sleeve 44 is bent along a circumferential surface of the developing sleeve 44. In addition, a position at which the facing member 47*b* faces the developing sleeve 44 is set at a position between magnetic poles which have the same polarity and are arranged to be adjacent each other, i.e., a position between the magnetic pole N2 and the magnetic pole N3. In doing so, it is possible to narrow the interval between the developing sleeve 44 and the partitioning wall 41*c* such that the developer supplied from the developing chamber 41*a* to the developing sleeve 44 is hard to drop into the agitating chamber 41*b*. In this embodiment, the interval between the developing sleeve 44 and the facing member 47*b* is set in a range from 0.35 mm to 2.5 mm. In doing so, the carrier borne on the surface of the developing sleeve 44 is retained between the developing sleeve 44 and the facing member 47*b* if the carrier is about to drop therebetween.

In this embodiment, the position of the apex 47*a* of the partitioning wall 41*c* is located below the upper end position of the zero-gauss zone, in which the magnetic force is substantially zero, between the magnetic pole N2 and the magnetic pole N3 as described above. Therefore, it is possible to increase the developer supplied to the developing sleeve 44 and to stabilize the property of coating the developing sleeve 44 with the developer. In addition, since the zero-gauss zone is widened by widening the interval between the magnetic pole N2 and the magnetic pole N3, which are repelling poles, it is possible to improve the property of peeling off the developer and to suppress the dragging of the developer by the developer bearing member. Accordingly, it is also possible to stabilize the property of coating the developing sleeve 44 with the developer from this viewpoint. In addition, the plurality of grooves 48 are formed on the surface of the developing sleeve 44 such that each of the grooves 48 has such an opening shape that the maximum diameter of the inscribed circle is equal to or greater than the average grain size of the carrier and the carrier with the average grain size can enter the opening by the depth that is equal to or greater than the radius thereof. Therefore, it is possible to easily constrain the developer on the developing sleeve 44. In doing so, the developer does not tend to drop into the agitating chamber 41*b* even if a large amount of developer is supplied from the developing chamber 41*a* to the developing sleeve 44, and further, even if it is hard to constrain the developer on the developing sleeve 44 by widening the zero-gauss zone. As a result, it is possible to provide the developing unit 4*a*, which secures the property of coating the developing sleeve 44 with the developer, in which unevenness of density and overflowing of the developer do not tend to occur.

EXAMPLE 1

Next, a description will be given of an experiment conducted in order to confirm the effect of the aforementioned embodiment. In the experiment, Example 1 of the configuration according to the embodiment described above with reference to FIG. 2 and the like was compared with configurations in Comparative Examples 1 and 2 illustrated in FIGS. 5 and 6. First, a description will be given of a configuration in Comparative Example 1 with reference to FIG. 5. In the case of a developing unit 400 in Comparative Example 1, conveyability of a surface of a developing sleeve 440 was secured by performing random ruggedness processing by blast processing on the surface of the developing sleeve 440 to obtain high surface roughness. In addition, a height of an apex 470*a* of a partitioning wall 410*c* between the first conveyor screw 42 and the developing sleeve 440 was located at a position above the zero-gauss zone, in which the magnetic force formed by the magnet roller 45 was substantially zero. That is, the position at which the magnetic force was substantially zero was located to be lower than the apex 470*a* by setting the height of the rising portion 470 to be higher than that in the embodiment.

This was based on the following reason. That is, the magnet roller 45 arranged inside the developing sleeve 440 in Comparative Example 1 also had the same magnetic pole arrangement as that in the embodiment. Therefore, it was difficult to constrain the developer on the developing sleeve 44 at a position at which the density of the magnetic fluxes formed by the magnetic poles N2 and N3 was substantially zero, and the developer tended to drop into the agitating chamber 41*b* without being constrained. In the case of the developing sleeve 440 after random ruggedness processing for high surface roughness as in Comparative Example 1, in particular, the surface roughness and the like tended to vary depending on the number of formed images, for example. Therefore, there was a possibility that the force carrying the developer by the developing sleeve 44 decreased as the period of use increased. Thus, in Comparative Example 1, the height of the apex 470*a* of the partitioning wall 410*c* was located at the position above the zero-gauss zone, in which the magnetic force formed by the magnet roller 45 was substantially zero, in order to prevent the developer from easily dropping into the agitating chamber 41*b*. In Comparative Example 1, the partitioning wall 410*c* was provided with a facing member 470*b* in the same manner as in the embodiment. The other configurations were the same as those in the embodiment.

Next, a description will be given of a configuration of Comparative Example 2 with reference to FIG. 6. In the case of a developing unit 401 in Comparative Example 2, random ruggedness processing by blast processing was performed on the surface of the developing sleeve 440 for high surface roughness in the same manner as in Comparative Example 1. In contrast, the height of the apex 47*a* of the partitioning wall 41*c* between the first conveyor screw 42 and the developing sleeve 440 was located at the position below the upper end position of the zero-gauss zone, in which the magnetic force formed by the magnet roller 45 was substantially zero, in the same manner as in the embodiment. The other configurations were the same as those in the embodiment.

Figure 5:
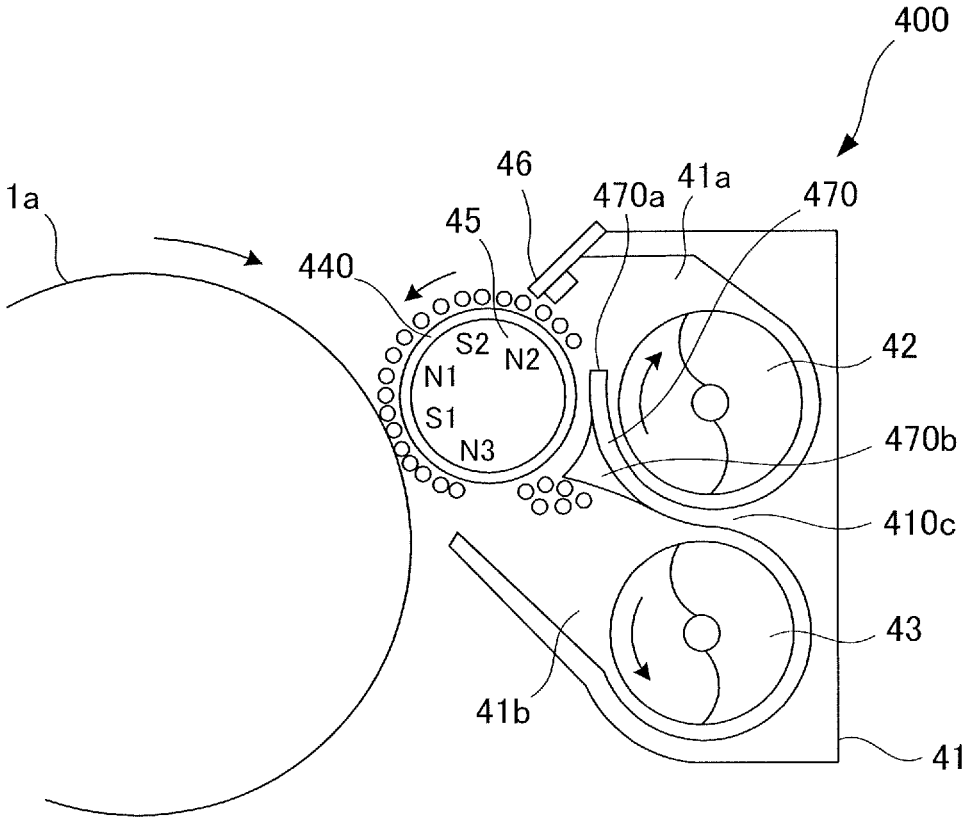
FIG. 5 is a cross section view illustrating a schematic configuration of a developing unit of Comparative Example 1.
Figure 6:
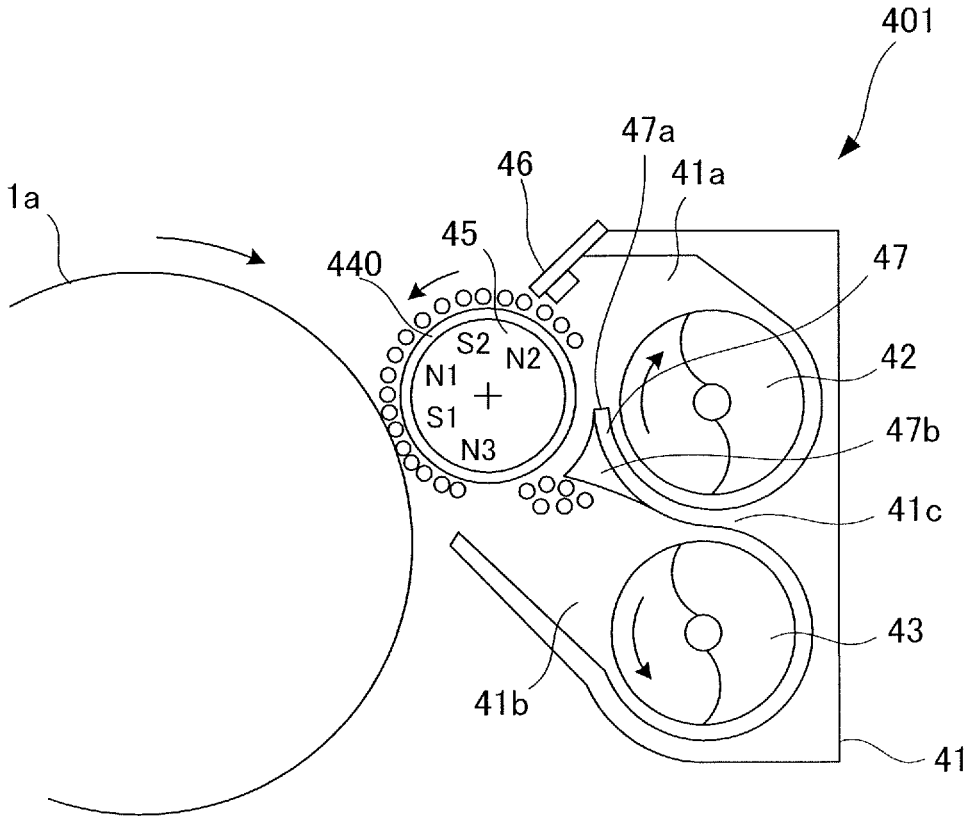
FIG. 6 is a cross section view illustrating a schematic configuration of a developing unit of Comparative Example 2.

The following comparative experiment was conducted while the aforementioned developing unit 4*a* according to Example 1 as illustrated in FIG. 2, the developing unit 400 according to Comparative Example 1 as illustrated in FIG. 5, and the developing unit 401 according to Comparative Example 2 as illustrated in FIG. 6 were respectively assembled in the image forming apparatus 100 as illustrated in FIG. 1. As conditions of the experiment, a weight ratio (T/D) between the toner and the carrier in the developer at the time of start was set to 8%, the same conditions such as an image ratio and an environment were set, and image formation was repeatedly performed on A4 sheets. Thereafter, images and development obtained by the respective developing units 4*a*, 400, and 401 were compared. First, no problems particularly occurred in all the developing units as a result of repeatedly performing image formation on 200000 sheets in an environment of 25° C. and 50%.

As a result of repeatedly performing the image formation on 200000 A4 sheets in an environment of 30° C. and 85% thereafter, unevenness of density occurred at a position corresponding to a downstream portion in the conveying direction of the first conveyor screw 42 in the developing unit 400 according to Comparative Example 1 in the course of the image formation. The developing unit 400 according to Comparative Example 1 was observed in this state, and a state was visually recognized in which the fluidity of the developer that was present in the developing unit 400 decreased and a height of the developer surface at the downstream portion in the conveying direction of the first conveyor screw 42 was lowered as compared to that before the start of image formation. It was possible to recognize that as a result, the developer was not able to be supplied to the developing sleeve 440 and unevenness of density occurred due to non-stability of the coating with the developer. In addition, it was possible to recognize that variations in fluidity tended to further decrease in a high-temperature and high-moisture environment as a result of further studies by the inventors. No particular problems occurred in the developing units in Comparative Example 2 and Example 1.

As a result of further repeatedly performing the image formation on 200000 A4 sheets in an environment of 20° C. and 10% thereafter, unevenness of density started to occur in the developing unit 401 according to Comparative Example 2 in the course of the image formation. Then, a carrier adhering image was generated at a position corresponding to the upstream side in the conveying direction of the first conveyor screw 42 before reaching 200000th image formation. The developing unit 401 according to Comparative Example 2 was observed in this state. A large amount of developer was present on the side of the agitating chamber 41*b*. In addition, it was possible to recognize that the developing sleeve 440 was coated with such a large amount of developer that the developer could not enter the agitating chamber 41*b* when the developer was collected in the agitating chamber 41*b* after completion of the developing process at the position facing the photosensitive drum 1*a*. Further detailed observation was conducted, and it was possible to visually recognize that the amount of the developer with which the developing sleeve 440 was coated decreased. As a result of observing the surface of the developing sleeve 440, the surface roughness seemed to have decreased and the surface seemed to have been further polished.

Figure 7:
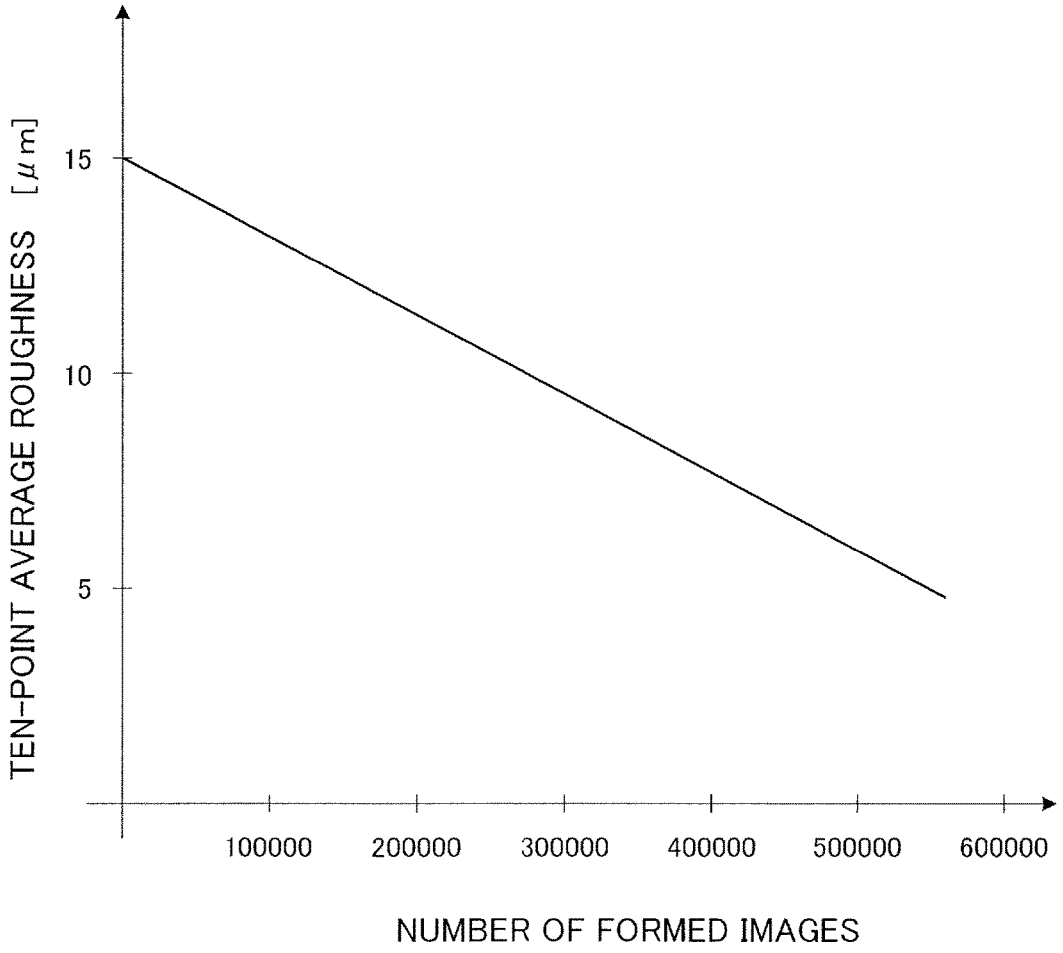
FIG. 7 is a diagram illustrating a relationship between surface roughness of the developing sleeve and the number of formed images.

Thus, the surface roughness of the developing sleeve 440 was measured by using a contact-type roughness measurement device Surfcorder SE3-300 (manufactured by Kosaka Laboratory Ltd.) capable of calculating ten-point average roughness Rz (JIS B 0601: 1994). As measurement conditions, a cut-off value was set to 0.8 mm, a measurement length was set to 2.5 mm, a feeding speed was set to 0.1 mm/sec, and a longitudinal magnification was set to 5000 times. As a result, Rz was 5 μm when the carrier adhering image was generated while Rz before the image formation was 15 μm. As a result of measuring the amounts of the developer, with which the developing sleeves 440 with Rz of 5 μm and 15 μm were coated, by using the developer before the image formation, it was possible to recognize that the amount of the developer, with which the developing sleeve with Rz of 5 μm was coated, decreased by about 40% and conveyability decreased by about 40%. FIG. 7 illustrates a relationship between the number of formed images and surface roughness of the developing sleeve 440. It is possible to recognize that Rz decreases as the number of formed images increases and Rz reaches about 5 μm when the number of formed images is about 550000.

Based on the experiment result of Comparative Example 2, it was possible to recognize that the developing sleeve 440 was not able to carry the developer due to the decrease in the conveyability of the developing sleeve 440, that the developer dropped on the side of the agitating chamber 41*b*, and that a large amount of developer was stored on the side of the agitating chamber 41*b*. In addition, it was possible to recognize that the developer was not able to be accommodated in the agitating chamber 41*b*, that overflowing of the developer occurred, and that the carrier adhering image was generated. It is noted that in regard to this point, it became apparent that environments caused substantially no difference as a result of the studies of the present inventors.

In contrast, there was substantially no difference between the amounts of the developer, with which the developing sleeve 44 in the developing unit 4*a* according to Example 1 was coated, before the image formation and after performing the image formation on 600000 sheets. In addition, no particular problems occurred in the developing unit 4*a* according to Example 1, and it was found that the developing unit in which unevenness of density and overflowing of the developer did not tend to occur was able to be provided.

[Second Embodiment]

A description will be given of a second embodiment of this disclosure with reference to FIGS. 8 to 10. The developing unit 40*a* according to the embodiment relates to a configuration that employs a multiple-stage developing system by which it is possible to increase opportunities of development. Specifically, predetermined density is secured by using a plurality of developing sleeves. More specifically, two developing sleeves are used in this embodiment. Such a configuration is preferably used in response to a further increase in speed of the image forming apparatus. Since the other configurations and the effects are the same as those of the aforementioned first embodiment, depiction of the same configurations will be omitted or the same reference numerals will be provided thereto for omitting or simplifying the descriptions. It is noted that hereinafter, differences from the first embodiment will be mainly described. Although a description will be given of the developing unit 40*a* in the image forming station Y (see FIG. 1) for the yellow color in this embodiment, the developing units in the other image forming stations also have the same configuration.

Figure 8:
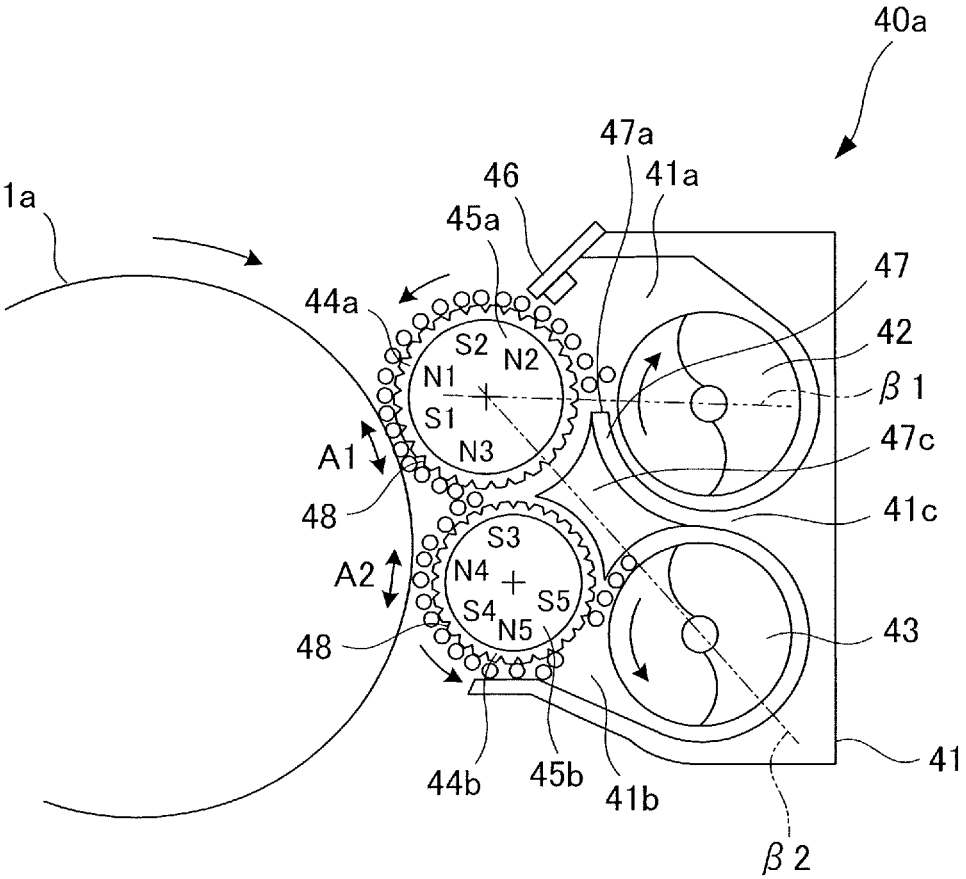
FIG. 8 is a cross section view illustrating a schematic configuration of a developing unit of a second embodiment.

As illustrated in FIG. 8, the developing unit 40*a* according to the embodiment is provided with the developing container 41, and a two-constituent developer containing a toner and a carrier is accommodated as a developer in the developing container 41. In addition, a developing sleeve 44*a* as the first developer bearing member, a developing sleeve 44*b* as the second developer bearing member, and the regulating blade 46 for regulating the nap of the developer that is borne on the developing sleeve 44*a* are included in the developing container 41. The developing sleeve 44*a* bears the developer supplied from the developing chamber 41*a* on the surface thereof and carries the developer. The developing sleeve 44*b* is provided below the developing sleeve 44*a*, bears the developer delivered from the developing sleeve 44*a* on the surface thereof, and carries the developer. The developing sleeve 44*a* is arranged such that the center position thereof is located at a higher position beyond the center position of the first conveyor screw 42. In addition, the first conveyor screw 42 is arranged such that the center thereof is positioned between the upper end and the lower end of the developing sleeve 44*a*. In this embodiment, the first conveyor screw 42 is arranged so as to be adjacent to the developing sleeve 44*a* in the substantially horizontal direction.

The developing sleeve 44*a* is rotated in the arrow direction (counterclockwise direction) in the drawing during the development. In addition, the developer is supplied from the developing chamber 41*a* as the first chamber, and the developing sleeve 44*a* bears the two-constituent developer, the layer thickness of which is regulated by a magnetic brush of the regulating blade 46 cutting the nap. Then, the developer is carried to a developing area A1 that faces the photosensitive drum 1*a* and is then supplied to an electrostatic latent image formed on the photosensitive drum 1 to develop the latent image. In contrast, the developing sleeve 44*b* is rotated in the arrow direction (counterclockwise direction) in the drawing during the development. Then, the developer after passing through the developing area A1 is delivered from the surface of the developing sleeve 44*a*. The developer delivered to the developing sleeve 44*b* is carried to a developing area A2 on the downstream side beyond the developing area A1 in the direction of rotation of the photosensitive drum 1, and is then supplied again to the electrostatic latent image formed on the photosensitive drum 1 to develop the latent image. Thereafter, the developer after contributing to the development is collected in the agitating chamber 41*b* as the second chamber from the developing sleeve 44*b* without passing through the developing chamber 41*a*. That is, the agitating chamber 41*b* forms a collecting path that collects the developer after the development, which is borne by the developing sleeve 44*b*, without causing the developer to pass through the developing chamber 41*a*.

In this embodiment, a plurality of parallel grooves 48 are formed in the axial direction on the surface of the developing sleeve 44*a* in the same manner as the developing sleeve 44 according to the first embodiment. Similarly, a plurality of parallel grooves 48 are formed in the axial direction on the surface of the developing sleeve 44*b*. It is noted that in addition, the developing sleeve 44*b* obtained by performing blast processing thereon in the same manner as the developing sleeve 440 illustrated in FIG. 5 may also be used.

The same magnet roller 45*a* as the magnet roller 45 according to the first embodiment is arranged inside the developing sleeve 44*a*. Positions, at which reference numerals of the respective magnetic poles are shown, in FIG. 8 substantially represent positions at which the magnetic force of the magnetic poles reaches peaks thereof. In addition, the magnetic pole N2 as the first magnetic pole is arranged so as to substantially face the regulating blade 46 such that the peak position of the magnetic force is located above the center of the developing sleeve 44*a* in the same manner as in the first embodiment. In addition, the magnetic pole N2 is arranged downstream in the conveying direction of a line β1 that connects the center of the developing sleeve 44*a* and the center of the first conveyor screw 42. In addition, the magnetic pole N3 as the second magnetic pole is arranged so as to be adjacent to the magnetic pole N2 on the upstream side and such that the peak position of the magnetic force is located below the center of the developing sleeve 44*a*. Moreover, the magnetic pole N3 is arranged upstream in the conveying direction of a line β2 that connects the center of the developing sleeve 44*a* and the center of the second conveyor screw 43. In addition, the magnetic pole N3 is arranged at a closest portion to the developing sleeve 44*b* from among the plurality of magnetic poles of the magnet roller 45*a*. Therefore, the magnetic pole N3 also functions as a delivery pole that delivers the developer from the developing sleeve 44*a* to the developing sleeve 44*b*.

In the embodiment, the magnetic poles N2 and N3 are arranged such that the center of the first conveyor screw 42 is positioned between the magnetic pole N2 and the magnetic pole N3, which are repelling poles, in the vertical direction. In other words, the first conveyor screw 42 is arranged such that the center thereof is located below the peak position of the magnetic force of the magnetic pole N2 and the upper side beyond the peak position of the magnetic force of the magnetic pole N3. In addition, the partitioning wall 41*c* is arranged such that a position of an apex 47*a* thereof is located between the developing sleeve 44*a* and the first conveyor screw 42, and is extended up to the position that is located below the upper end position of the zero-gauss zone, in which the magnetic force is substantially zero, between the magnetic pole N2 and the magnetic pole N3 in the same manner as in the first embodiment. In the embodiment, the position of the apex 47*a* is similarly located on the lower side than the minimal position of the magnetic force in the zero-gauss zone. It is noted that in addition, definitions of such a zero-gauss zone and the minimal position are the same as those in the first embodiment.

In addition, the partitioning wall 41*c* is formed such that the position of the apex 47*a* is located below the line β1 that connects the center of the developing sleeve 44*a* and the center of the first conveyor screw 42. In the configuration including two developing sleeves as in the embodiment, in particular, it is preferable to locate the position of the developing sleeve 44*b* on the upper side to the maximum extent with respect to the agitating chamber 41*b* in consideration of a property of collecting the developer from the developing sleeve 44*b* on the lower side to the agitating chamber 41*b*. For example, the developing sleeve 44*b* is preferably arranged such that the center position thereof is higher than the center position of the second conveyor screw 43. In doing so, the position of the developing sleeve 44*a* that is arranged above the developing sleeve 44*b* tends to be high, and as a result, the position of the apex 47*a* tends to be located below the line β1. In such a case, since the developer supplied from the developing chamber 41*a* to the developing sleeve 44*a* tends to drop, the problem that the developer drops into the agitating chamber 41*b* more seriously occurs in the configuration employing the two developing sleeves as in the embodiment.

In contrast, a magnet roller 45*b* is arranged inside the developing sleeve 44*b*. The magnet roller 45*b* includes a plurality of magnetic poles S3, S4, S5, N4, and N5. The magnetic pole N4 is a developing pole that is arranged at a developing portion that faces the photosensitive drum 1*a*. The magnetic pole S3 is arranged at a position at which the magnetic pole S3 substantially faces the magnetic pole N3 of the magnet roller 45*a* inside the developing sleeve 44*a*, and the developer is delivered from the developing sleeve 44*a* at this position. The magnetic pole S5 is arranged so as to be adjacent to the magnetic pole S3 on the upstream side in the direction of rotation of the developing sleeve 44*b*. For this reason, the developer that is borne by the developing sleeve 44*b* is peeled off from the surface of the developing sleeve 44*b* between the magnetic pole S5 and the magnetic pole S3 and is then collected in the agitating chamber 41*b*. The magnetic poles S4 and N5 are arranged between the magnetic pole S5 and the magnetic pole N4.

In addition, the partitioning wall 41*c* includes a facing member 47*c* that is provided so as to be adjacent to and face the developing sleeve 44*a* and the developing sleeve 44*b*. The facing member 47*c* is provided so as to protrude from a portion between an intermediate portion of the partitioning wall 41*c* and the rising portion 47 toward the developing sleeve 44*a* and the developing sleeve 44*b*. In addition, a surface of the facing member 47*c*, which faces the surface of the developing sleeve 44*a*, is bent along a circumferential surface of the developing sleeve 44*a*, and a surface thereof, which faces the surface of the developing sleeve 44*b*, is bent along the surface of the developing sleeve 44*b*. The positions at which the facing member 47*c* faces the developing sleeve 44*a* and the developing sleeve 44*b* are located between the adjacent magnetic poles N2 and the magnetic pole N3 with the same polarity and between the magnetic pole S5 and the magnetic pole S3, respectively. In doing so, it is possible to narrow the intervals between the developing sleeves 44*a* and 44*b* and the partitioning wall 41*c* in order to prevent the developer supplied from the developing chamber 41*a* to the developing sleeve 44*a* from tending to drop into the agitating chamber 41*b*. In this embodiment, the interval between the developing sleeve 44*a* and the facing member 47*c* is set within a range from 0.35 mm to 2.5 mm.

In doing so, the carrier born on the surface of the developing sleeve 44 is retained between the developing sleeve 44 and the facing member 47*b* if the carrier is about to drop therebetween.

In the embodiment, the position of the apex 47*a* of the partitioning wall 41*c* is similarly located below the position, at which the magnetic force is substantially zero, between the magnetic pole N2 and the magnetic pole N3. Therefore, it is possible to increase the developer supplied to the developing sleeve 44*a* and to stabilize the property of coating the developing sleeve 44*a* with the developer. In addition, since the zero-gauss zone is widened by widening the interval between the magnetic pole N2 and the magnetic pole N3, which are repelling poles, it is possible to improve the property of peeling off the developer and to suppress the dragging of the developer by the developer bearing member. Accordingly, it is also possible to stabilize the property of coating the developing sleeve 44*a* with the developer from this viewpoint. In addition, the plurality of grooves 48 are formed on the surface of the developing sleeve 44*a* such that each of the grooves 48 has such an opening shape that the maximum diameter of the inscribed circle is equal to or greater than the diameter of the average grain size of the carrier and the carrier with the average grain size can enter each of the groove 48 by the depth that is equal to or greater than the radius thereof. Therefore, the developer is easily constrained on the developing sleeve 44*a*. In doing so, the developer does not tend to drop into the agitating chamber 41*b* even if a large amount of developer is supplied from the developing chamber 41*a* to the developing sleeve 44*a*, and further, even if it is hard to constrain the developer on the developing sleeve 44*a* by widening the zero-gauss zone. It is possible to suppress the dropping of the developer even in the configuration in which the two developing sleeves are provided, the position of the developing sleeve 44*a* on the upper side is high, and the position of the apex 47*a* is located below the line β as in the embodiment, in particular. As a result, it is possible to provide the developing unit 4*a*, which secures the property of coating the developing sleeve 44*a* with the developer, in which unevenness of density and overflowing of the developer do not tend to occur.

EXAMPLE 2

Next, a description will be given of an experiment conducted in order to confirm the effect of the aforementioned embodiment. In the experiment, Example 2 of the configuration according to the embodiment as described above with reference to FIG. 8 was compared with configurations according to Comparative Examples 3 and 4 illustrated in FIGS. 9 and 10. First, a description will be given of a configuration in Comparative Example 3 with reference to FIG. 9. In the developing unit 402 according to Comparative Example 3, conveyability of the surfaces of the developing sleeves 440*a* and 440*b* was secured by performing random roughness process by blast processing on surfaces of the developing sleeves 440*a* and 440*b* for high surface roughness. In addition, the height of the apex 470*a* of the partitioning wall 410*c* between the first conveyor screw 42 and the developing sleeve 440*a* was located at a position above the zero-gauss zone, in which magnetic force formed by the magnet roller 45*a* was substantially zero. That is, the position at which the magnetic force was substantially zero was located to be lower than the apex 470*a* by setting the height of the rising portion 470 to be higher than that in the embodiment. In Comparative Example 3, the partitioning wall 410*c* is provided with a facing member 470*c* in the same manner as in the embodiment. The other configurations were the same as those in the embodiment.

Next, a description will be given of a configuration in Comparative Example 4 with reference to FIG. 10. In the developing unit 403 according to Comparative Example 4, random roughing process by blast processing was performed on the surfaces of the developing sleeves 440*a* and 440*b* for high surface roughness in the same manner as in Comparative Example 3. In contrast, the height of the apex 47*a* of the partitioning wall 41*c* between the first conveyor screw 42 and the developing sleeve 440*a* was set at a position below the upper end position of the zero-gauss zone, in which the magnetic force formed by the magnet roller 45 was substantially zero in the same manner as in the embodiment. The other configurations were the same as those in the embodiment.

Figure 9:
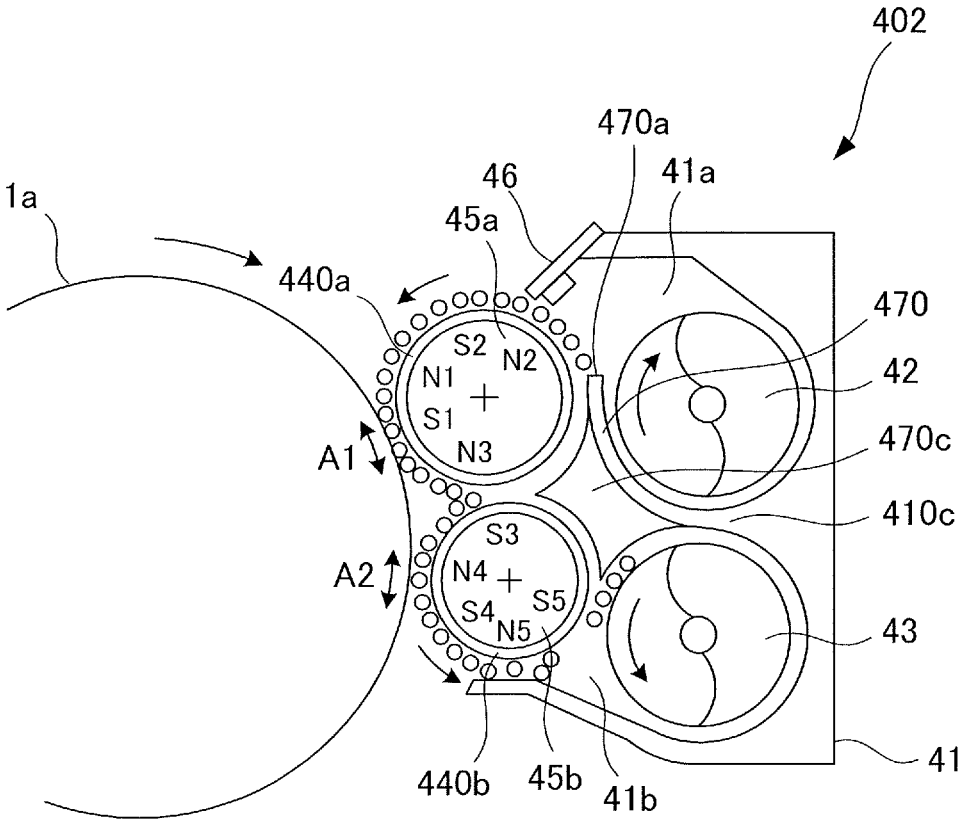
FIG. 9 is a cross section view illustrating a schematic configuration of a developing unit of Comparative Example 3.
Figure 10:
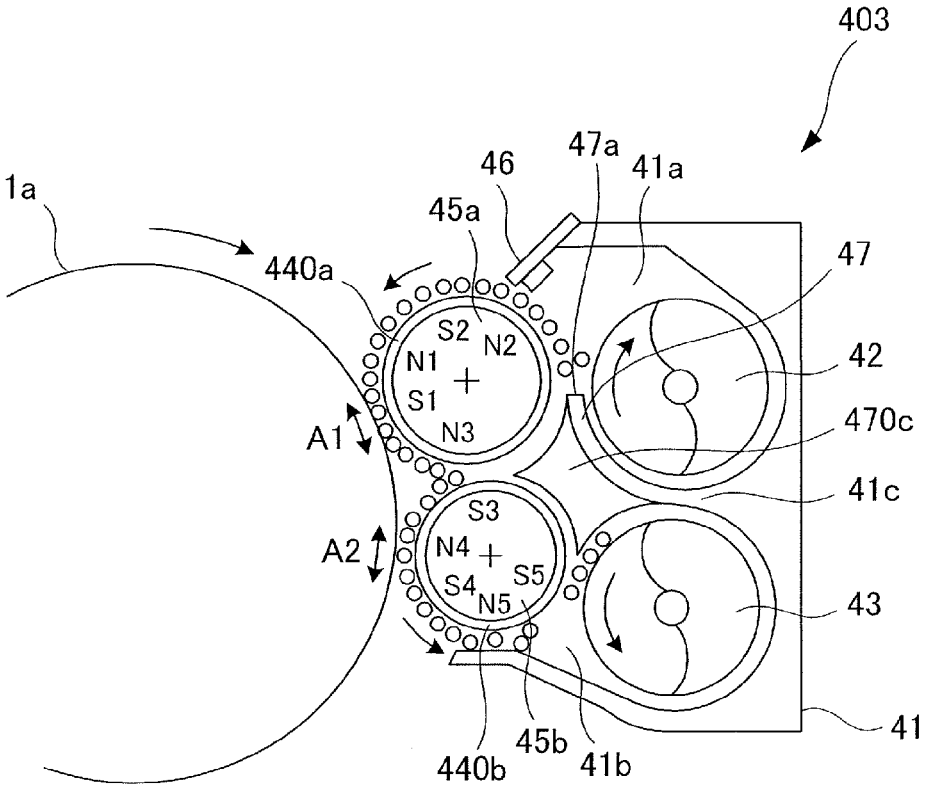
FIG. 10 is a cross section view illustrating a schematic configuration of a developing unit of Comparative Example 4.

The following comparative experiment was conducted while the aforementioned developing unit 40*a* according to Example 2 as illustrated in FIG. 8, the developing unit 402 according to Comparative Example 3 as illustrated in FIG. 9, and the developing unit 403 according to Comparative Example as illustrated in FIG. 10 were respectively assembled in the image forming apparatus 100 as illustrated in FIG. 1. As conditions of the experiment, a weight ratio (T/D) between the toner and the carrier in the developer at the time of start was set to 8%, the same conditions such as an image ratio and an environment were set, and image formation was repeatedly performed on A4 sheets. Thereafter, images and development obtained by the respective developing units 40*a*, 402, and 403 were compared.

First, unevenness of density occurred in the developing unit 402 according to Comparative Example 3 (FIG. 9) in a high-temperature and high-moisture environment. In the case of the developing unit 403 according to Comparative Example 4 (FIG. 10), images that were not smooth were obtained as the number of formed images increased, and thereafter, a carrier adhering image was generated at the position corresponding to the upstream of the first conveyor screw 42 in the conveying direction. The developing unit 403 according to Comparative Example 4 was observed in this state, and it was possible to recognize that the amount of the developer with which the developing sleeve 440*b* was coated was about three times as that before the image formation. In addition, it was possible to recognize that retention of the developer occurred in the area A2 at which the photosensitive drum 1*a* and the developing sleeve 440*b* were at the closest portions and that overflowing of the developer occurred. Moreover, it was possible to recognize that the surface roughness of the developing sleeve 44*a* decreased to about 5 μm.

This was because the developer, which had passed and dropped between the developing sleeve 440*a* and the facing member 470*c* provided in the vicinity of the zero-gauss area, passed between the developing sleeve 440*a* and the developing sleeve 440*b* and was then supplied to the developing sleeve 440*b*. That is, the developer supplied to the developing sleeve 440*b* as described above joined the developer that was delivered to the developing sleeve 440*b* from the developing sleeve 440*a* through a regular route, and the amount of the developer, with which the developing sleeve 440*b* was coated, increased. As a result, the amount of the developer with which the developing sleeve 440*b* was coated increased to about three times as large as the original amount, the developer was not able to pass through the position at which the photosensitive drum 1 and the developing sleeve 440*b* were at the closest portions, and the carrier adhering image was generated.

In contrast, no particular problems occurred in the developing unit 40*a* according to Example 2 (FIG. 8), and it was possible to recognize that the developing unit 40*a* in which unevenness of density and overflowing of the developer did not tend to occur was able to be provided.

[Other Embodiments]

Figure 11A:
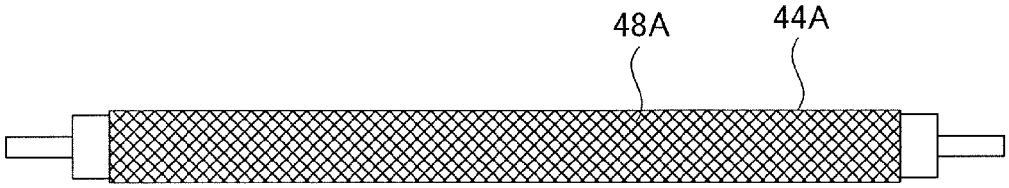
FIG. 11A is a planar view illustrating a first example of a developing sleeve of another embodiment.
Figure 11B:
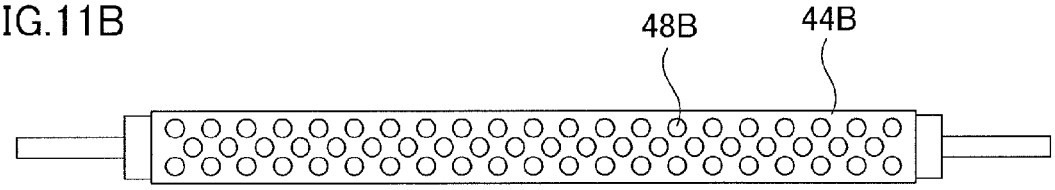
FIG. 11B is a planar view illustrating a second example of a developing sleeve of another embodiment.
Figure 11C:
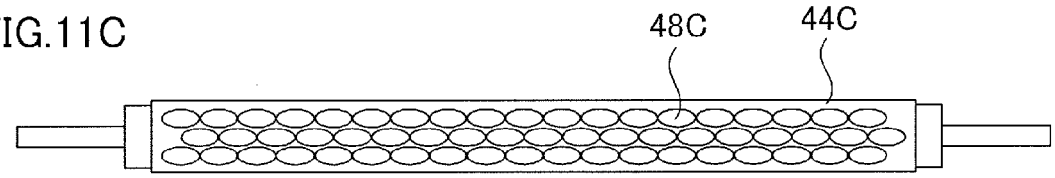
FIG. 11C is a planar view illustrating a third example of a developing sleeve of another embodiment.
Figure 11D:
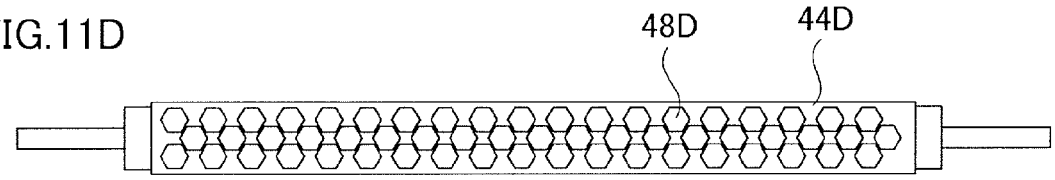
FIG. 11D is a planar view illustrating a fourth example of a developing sleeve of another embodiment.

In the aforementioned respective embodiments, the plurality of grooves 48 are formed as the plurality of concaved portions on the surfaces of the developing sleeves 44 and 44*a*. However, the plurality of concaved portions are not limited to the grooves, and concaved portions with other shapes are also applicable as long as substantially no changes occur in the surface shapes even if the number of formed images increases and conveyability of the developer is barely changed. For example, a plurality of grooves 48A may be formed on a surface of a developing sleeve 44A so as to intersect at two different angles as illustrated in FIG. 11A. In addition, a plurality of concaved portions 48B with circular opening shapes may be formed on a surface of a developing sleeve 44B as illustrated in FIG. 11B. Alternatively, a plurality of concaved portions 48C with elliptical opening shapes may be provided on a surface of a developing sleeve 44C as illustrated in FIG. 11C. Furthermore, a plurality of concaved portions 48D with polygonal opening shapes may be provided on a surface of a developing sleeve 44D as illustrated in FIG. 11D. Each of these grooves 48A and concaved portions 48B, 48C, and 48D has such an opening shape that the maximum diameter of an inscribed circle is equal to or greater than the diameter of the average grain size of the carrier and the carrier with the average grain size can enter each of the concaved portions by a depth that is equal to or greater than the radius thereof.

A specific sectional shape of each of the grooves 48 according to the aforementioned respective embodiments and the grooves 48A and the concaved portions 48B, 48C, and 48D illustrated in FIGS. 11A to 11D may be a V shape as illustrated in FIGS. 4A to 4C or may be another shape. For example, a curved sectional shape or a concave shape including a bottom surface and side walls surrounding the bottom surface is also applicable. In any cases, any opening shapes and sectional shapes of the concaved portions are applicable as long as each of the concaved portions has such an opening shape that the maximum diameter of the inscribed circle is equal to or greater than the diameter of the average grain size of the carrier and the carrier with the average grain size can enter each of the concaved portions by the depth that is equal to or greater than the radius thereof.

Although the configuration in which the regulating blade 46 as the regulation member was arranged at the position at which the regulating blade 46 faced the magnetic pole N2 as the first magnetic pole was described in the aforementioned respective embodiments. This was for preventing a large amount of developer to be present in the vicinity of the regulating blade 46 and reducing stress applied to the developer as described above. However, the developing unit according to this disclosure is not limited to such a configuration and can also be applied to a configuration in which the regulating blade 46 faces the magnetic pole S2 in FIG. 2, for example. That is, this disclosure is applicable to any configurations as long as the first magnetic pole is arranged at the position at which the first magnetic pole faces the regulating blade 46 or on the upstream side in the direction of rotation of the developing sleeve beyond the position and the second magnetic pole with the same polarity as that of the first magnetic pole is arranged so as to be adjacent to the first magnetic pole on the upstream side.

In addition, the material of the photosensitive drum and the configurations and the like of the developer and the image forming apparatus that are employed in the image forming apparatus according to the aforementioned respective embodiments are not limited thereto, and it is needless to state that this disclosure can be applied to various developers and various image forming apparatuses. Specifically, colors and the number of colors of the toner, whether or not to contain wax, an order of toner development of the respective colors, the number of first and second conveyor screws, and the like are not limited to the above description. This disclosure is also applicable to developing units with other configurations, such as a function separating type in which the first and second conveyor screws are arranged at a small angle in the vertical direction, for example.

Furthermore, the image forming apparatus using the developing unit according to this disclosure is an image forming apparatus that forms an image by using the electrophotographic system, and is applicable to a copier, a printer, a fax or a multi-purpose peripheral provided with such a plurality of functions, in particular.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-194939, filed Sep. 25, 2014 and No. 2015-141076, filed Jul. 15, 2015, which are hereby incorporated by reference herein in their entirety.

What is claimed is:

1. A developing apparatus, comprising:

a developer bearing member configured to bear a developer, containing a non-magnetic toner and a magnetic carrier, on a surface thereof;

a developer accommodating portion configured to accommodate the developer, the developer accommodating portion including:

a first chamber configured to supply the developer to the developer bearing member;

a second chamber arranged below the first chamber in a state in which the developing apparatus is mounted in an image forming apparatus and configured to form a collecting path to collect the carried developer through the developer bearing member after development without causing the developer to pass through the first chamber and a circulation path circulating the developer between the first chamber and the second chamber; and a partitioning wall configured to partition the first chamber and the second chamber;

a first conveying member configured to be arranged in the first chamber such that the center thereof is positioned between an upper end and a lower end of the developer bearing member, and to convey the developer;

a second conveying member configured to be arranged in the second chamber and convey the developer;

a regulation member configured to regulate the amount of developer that is borne by the developer bearing member; and a multipolar magnet arranged inside the developer bearing member, the multipolar magnet including:

a first magnetic pole arranged at a position where the first magnetic pole faces the regulation member or on a position upstream, in a conveying direction of the developer bearing member, of the position where the first magnetic pole faces the regulation member such that a peak position of magnetic force on the surface of the developer bearing member is located above a center of the developer bearing member and is located downstream, in the conveying direction, of a line that connects the center of the developer bearing member and the center of the first conveying member; and a second magnetic pole having the same polarity with that of the first magnetic pole, the second magnetic pole arranged to be adjacent to the first magnetic pole upstream, in the conveying direction, of the first magnetic pole such that a peak position of magnetic force on the surface of the developer bearing member is located below the center of the developer bearing member and is located downstream, in the conveying direction, of a line that connects the center of the developer bearing member and the center of the second conveying member, wherein an apex position of the partitioning wall is located between the developer bearing member and the first conveying member, below an upper end position of a zone in which magnetic force on the surface of the developer bearing member is less than 50 gauss between the first magnetic pole and the second magnetic pole, and above a peak position of magnetic force of the second magnetic pole, wherein the apex position of the partitioning wall is located below a minimal position at which magnetic force is the smallest in the zone, wherein a plurality of concaved portions is formed on a surface of the developer bearing member at an interval, and wherein each of the plurality of concaved portions has such an opening shape that a maximum diameter of an inscribed circle is equal to or greater than a diameter of an average grain size of the carrier, and is formed such that the carrier with the average grain size is able to enter each of the concaved portions by a depth that is equal to or greater than a radius thereof.

2. The developing apparatus according to claim 1, wherein the multipolar magnet is arranged at the position where the first magnetic pole faces the regulation member.

3. The developing apparatus according to claim 1, wherein the first conveying member is arranged such that the center thereof is located below the peak position of the magnetic force of the first magnetic pole and above the peak position of the magnetic force of the second magnetic pole.

4. The developing apparatus according to claim 1, wherein the partitioning wall is formed such that the apex position thereof is located below the line that connects the center of the developer bearing member and the center of the first conveying member.

5. The developing apparatus according to claim 1, wherein the partitioning wall includes a facing member that is provided so as to be adjacent to and face the developer bearing member along the surface of the developer bearing member.

6. The developing apparatus according to claim 5, wherein the interval between the developer bearing member and the facing member being set in a range from 0.35 mm to 2.5 mm.

7. The developing apparatus according to claim 1, wherein the developer bearing member is arranged such that the position of the center thereof is located at a higher position beyond the position of the center of the first conveying member.

8. The developing apparatus according to claim 1, wherein the interval between the plurality of concaved portions in the conveying direction is equal to or greater than the maximum diameter of the inscribed circle of the opening shape of each of the concaved portions.

9. The developing apparatus according to claim 1, wherein the plurality of concaved portions are a plurality of grooves that are formed in a direction that intersects the conveying direction of the developer bearing member, and wherein the plurality of grooves are formed at an interval in the conveying direction.

10. The developing apparatus according to claim 1, wherein the concaved portions are formed to have at least one of a circular shape, an elliptical shape, and a polygonal shape.

11. The developing apparatus according to claim 1, wherein the second chamber collects the developer from the developer bearing member.

12. The developing apparatus according to claim 1, further comprising:

a second developer bearing member provided below a first developer bearing member which is the developer bearing member, the second developer bearing member configured to bear the developer, which is carried from the first developer bearing member, on a surface thereof, and carry the developer, wherein the second chamber collects the developer from the second developer bearing member.

13. A developing apparatus comprising:

a developer bearing member configured to bear a developer, containing a non-magnetic toner and a magnetic carrier, on a surface thereof;

a developer accommodating portion configured to accommodate the developer, and the developer accommodating portion including:

a first chamber configured to supply the developer to the developer bearing member;

a second chamber arranged below the first chamber in a state in which the developing apparatus is mounted in an image forming apparatus and configured to form a collecting path to collect the carried developer through the developer bearing member after development without causing the developer to pass through the first chamber and a circulation path circulating the developer between the first chamber and the second chamber; and a partitioning wall configured to partition the first chamber and the second chamber;

a first conveying member configured to be arranged in the first chamber such that the center thereof is positioned between an upper end and a lower end of the developer bearing member, and to convey the developer;

a second conveying member configured to be arranged in the second chamber and convey the developer;

a regulation member configured to regulate the amount of developer that is borne by the developer bearing member; and a multipolar magnet arranged inside the developer bearing member, the multipolar magnet including:

a first magnetic pole arranged at a position where the first magnetic pole faces the regulation member or on a position upstream, in a conveying direction of the developer bearing member, of the position where the first magnetic pole faces the regulation member such that a peak position of magnetic force thereof is located above a center of the developer bearing member; and a second magnetic pole having the same polarity with that of the first magnetic pole, the second magnetic pole arranged to be adjacent to the first magnetic pole upstream, in the conveying direction, of the first magnetic pole such that a peak position of magnetic force on the surface of the developer bearing member is located below the center of the developer bearing member, wherein the partitioning wall is arranged such that an apex position thereof is located between the developer bearing member and the first conveying member and is extended up to a position which is located below an upper end position of a zone in which magnetic force on the surface of the developer bearing member is less than 50 gauss between the first magnetic pole and the second magnetic pole, with the apex position being above a peak position of magnetic force of the second magnetic pole, wherein the apex position of the partitioning wall is located below a minimal position at which magnetic force is the smallest in the zone, wherein a plurality of concaved portions are formed on a surface of the developer bearing member at an interval, and wherein each of the plurality of concaved portions has such an opening shape that a maximum diameter of an inscribed circle is equal to or greater than a diameter of an average grain size of the carrier, and is formed such that the carrier with the average grain size is able to enter each of the concaved portions by a depth that is equal to or greater than a radius thereof.

14. The developing apparatus according to claim 13, wherein the partitioning wall includes a facing member that is provided so as to be adjacent to and face the developer bearing member along the surface of the developer bearing member.

15. The developing apparatus according to claim 14, wherein the interval between the developer bearing member and the facing member being set in a range from 0.35 mm to 2.5 mm.

16. A developing apparatus comprising:

a first developer bearing member configured to bear a developer, containing a non-magnetic toner and a magnetic carrier, on a surface thereof;

a second developer bearing member provided below the first developer bearing member in a state in which the developing apparatus is mounted in an image forming apparatus, the second developer configured to bear the developer, which is carried from the first developer bearing member, on a surface thereof;

a developer accommodating portion configured to accommodate the developer, the accommodating portion including:

a first chamber configured to supply the developer to the first developer bearing member;

a second chamber arranged below the first chamber in a state in which the developing apparatus is mounted in an image forming apparatus and configured to form a collecting path to collect the carried developer through the first developer bearing member after development without causing the developer to pass through the first chamber and a circulation path circulating the developer between the first chamber and the second chamber, and a partitioning wall configured to partition the first chamber and the second chamber;

a first conveying member configured to be arranged in the first chamber such that the center thereof is positioned between an upper end and a lower end of the first developer bearing member, and to convey the developer;

a second conveying member configured to be arranged in the second chamber and convey the developer;

a regulation member configured to regulate the amount of developer that is borne by the first developer bearing member; and a multipolar magnet arranged inside the first developer bearing member, the multipolar magnet including:

a first magnetic pole arranged at a position where the first magnetic pole faces the regulation member or on a position upstream, in a conveying direction of the first developer bearing member, of the position where the first magnetic pole faces the regulation member such that a peak position of magnetic force on the surface of the developer bearing member is located above a center of the first developer bearing member; and a second magnetic pole having the same polarity with that of the first magnetic pole, the second magnetic pole arranged to be adjacent to the first magnetic pole upstream, in the conveying direction, of the first magnetic pole such that a peak position of magnetic force on the surface of the developer bearing member being located below the center of the first developer bearing member, wherein the partitioning wall is arranged such that an apex position thereof is located between the first developer bearing member and the first conveying member, is extended up to a position where the apex position is located below an upper end position of a zone in which magnetic force on the surface of the developer bearing member is less than 50 gauss between the first magnetic pole and the second magnetic pole, and above a peak position of magnetic force of the second magnetic pole, wherein the apex position of the partitioning wall is located below a minimal position at which magnetic force is the smallest in the zone, wherein a plurality of concaved portions are formed on a surface of the first developer bearing member at an interval, and wherein each of the plurality of concaved portions has such an opening shape that a maximum diameter of an inscribed circle is equal to or greater than a diameter of an average grain size of the carrier, and is formed such that the carrier with the average grain size is able to enter each of the concaved portions by a depth that is equal to or greater than a radius thereof.

17. The developing apparatus according to claim 16, wherein the second magnetic pole is arranged at a position at which the second magnetic pole is closest to the second developer bearing member from among the plurality of magnetic poles of the multipolar magnet.

18. The developing apparatus according to claim 16, wherein the partitioning wall includes a facing member that is provided so as to be adjacent to and face the first developer bearing member along the surface of the first developer bearing member.

19. The developing apparatus according to claim 18, wherein the interval between the first developer bearing member and the facing member being set in a range from 0.35 mm to 2.5 mm.

20. The developing apparatus according to claim 16, wherein the plurality of concaved portions are a plurality of grooves that are formed in a direction that intersects the conveying direction of the first developer bearing member, and wherein the plurality of grooves are formed at an interval in the conveying direction.

* * * * *